US006290226B1

(12) United States Patent
DeFigueiredo et al.

(10) Patent No.: US 6,290,226 B1
(45) Date of Patent: Sep. 18, 2001

(54) DUAL BIN ENVELOPE SUPPLY DEVICE AND METHOD

(75) Inventors: Carlos L DeFigueiredo, Sandy Hock; Linda A. Howard, Brookfield, both of CT (US); John W. Sussmeier, Cold Spring, NY (US); William J. Wright, Killingworth; Karel J. Janatka, Southbury, both of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/471,755

(22) Filed: Dec. 23, 1999

(51) Int. Cl.[7] ..... B06H 43/04

(52) U.S. Cl. ..... 271/223; 271/171; 271/207; 271/303

(58) Field of Search ..... 270/58.06; 271/171, 271/223, 303, 207

(56) References Cited

U.S. PATENT DOCUMENTS 4,799,663 * 1/1989 Golicz ..... 271/213 X
4,908,673 * 3/1990 Muramatsu ..... 271/171 X
5,076,562 * 12/1991 Sai et al. ..... 271/171 X
5,244,200 * 9/1993 Manzke ..... 271/198
5,590,873 * 1/1997 Smart et al. ..... 271/303
5,692,745 * 12/1997 Neifert et al. ..... 271/223 X
5,813,668 * 9/1998 Lund ..... 271/2
6,073,925 * 6/2000 Sato ..... 271/171

* cited by examiner

*Primary Examiner*—Donald P. Walsh
*Assistant Examiner*—Patrick Mackey
(74) *Attorney, Agent, or Firm*—Michael J. Cummings; Michael E. Melton

(57) ABSTRACT

A method and system for transporting envelopes from an envelope feeder to an envelope staging area in an envelope insertion machine. The envelope transport system includes two envelope bins and two envelope supply paths linking the envelope bins to an envelope feeder. Each of the bins is used to temporarily store an envelope before that envelope is moved to the staging area. The envelope supply paths are controlled by a flipper gate which alternately opens one path and closes another so as to allow an envelope to enter one envelope bin while another envelope in the other envelope bin is moved to the staging area. With the dual envelope bins connected to the dual supply paths to receive envelopes released by the envelope feeder, the envelope feeder does not have to slow down substantially in order to wait for the released envelope to clear the feeding path.

12 Claims, 9 Drawing Sheets

DUAL BIN ENVELOPE SUPPLY DEVICE AND METHOD

TECHNICAL FIELD

The present invention generally relates to an envelope insertion machine and, more feeder and an envelope staging area in the envelope insertion machine, and, more particularly, to the envelope supply paths for connecting the envelope transport paths between an envelope.

BACKGROUND OF THE INVENTION

In an envelope insertion machine for mass mailing, there is an envelope feeder on one end of the machine to sequentially release envelopes directly into an envelope staging area, and a gathering section on the other end where the enclosure material is released and gathered. If the enclosure material contains many documents, these documents must be separately released from different enclosure feeders. The released documents must also be collated into a stack and moved to the envelope staging area where the document stack is inserted into an envelope by an insertion engine. In some envelope insertion machines, however, the movement of the envelopes from the envelope feeder to the envelope staging area involves a right-angle turn. In those machines, although the envelopes can be fed at a high feeding rate and moved at a high speed after they are released, each envelope must be slowed down or momentarily stopped before it can make a drastic turn to enter into the envelope staging area.

Because of the requirement for the right-angle turn, the envelope feeder must also be slowed down to wait for the previously released envelope to move out of the feeding path. Thus, the right-angle turn movement reduces the feeder rate that is otherwise attainable by the envelope feeder. Consequently, the throughput of the envelope insertion machine is also substantially reduced. In a high-speed envelope insertion machine wherein the machine throughput is required to reach 18,000 insertions per hour, the reduced velocity of the envelopes due to the right-angle turn requirement causes a bottle-neck in the entire insertion system.

Therefore, it is advantageous and desirable to provide a method and a system for transporting the envelopes released from the envelope feeder to the envelope staging area so as to solve the above-described bottle-neck problem in an envelope insertion machine.

SUMMARY OF THE INVENTION

The present invention provides an envelope transport system having two envelope bins and two envelope supply paths linking the envelope bins to an envelope feeder. Each envelope bin is used to temporarily store an envelope before that envelope is moved to the staging area. The envelope supply paths are controlled by a flipper gate which alternately opens one path and closes the other so as to allow an envelope feeder to feed an envelope into one envelope bin while waiting for the preceding envelope to be transported out of the other envelope bin to the staging area. With the dual envelope bins connected to the dual supply paths, the envelope feeder does not have to slow down substantially in order to wait for the released envelopes to clear the feeding path.

Accordingly, the first aspect of the present invention is to provide a system for transporting envelopes in an envelope insertion machine having an envelope feeder and an envelope staging area. The system comprises two envelope bins, each of which is connected to a different envelope supply path to receive one envelope at a time from the envelope feeder in an alternate fashion so as to allow the received envelope to slow down before it is transported out of the envelope bin to the envelope staging area.

Preferably, each envelope bin has a catch mechanism located at the bin entrance to prevent an envelope, which has entered the bin, from moving out of the entrance in an opposite direction, and a stop mechanism located at the opposing end to keep the entered envelope from moving out of the envelope bin from the opposite end and to momentarily slow down the entered envelope.

Preferably, each envelope bin has a width defined by the stop mechanism and the catch mechanism and the bin width is adjustable in accordance with the width of the envelope.

Preferably, a coupling device mechanically connects the two envelope bins so that the width of both envelope bins can be simultaneously adjusted.

Preferably, the stop mechanism is operable in a first position to stop an entering envelope from moving out of the bin end along the entering direction and a second position to allow the entered envelope to move out of the bin along the entering direction, if needed.

The second aspect of the invention is to provide a method of transporting envelopes released by the envelope feeder to the envelope staging area in the envelope insertion machine. The method comprises the step of feeding the released envelopes into two envelope bins in an alternate fashion so that one envelope is temporarily stored in one of the envelope bins while the preceding envelope is transported out of the other envelope bin to the staging area.

The third aspect of the invention is to provide a method of simultaneously adjusting the width of the dual envelope bins. The method comprises the steps of: a) engaging the stop mechanism and the catch mechanism of one envelope bin with a first adjustment device for adjusting the distance between the mechanism and the catch mechanism of that envelope bin; b) engaging the stop mechanism and the catch mechanism of the other envelope bin with a second adjustment device for adjusting the distance of the stop mechanism and the catch mechanism of that other envelope bin, and c) coupling the first adjustment device to the second adjustment device so that the distance between the stop mechanism and the stop mechanism of each of the envelope bins can be simultaneously adjusted.

The present invention will become apparent upon reading the description taken in conjunction with FIGS. 1 to 8.

DETAILED DESCRIPTION

Figure 1:
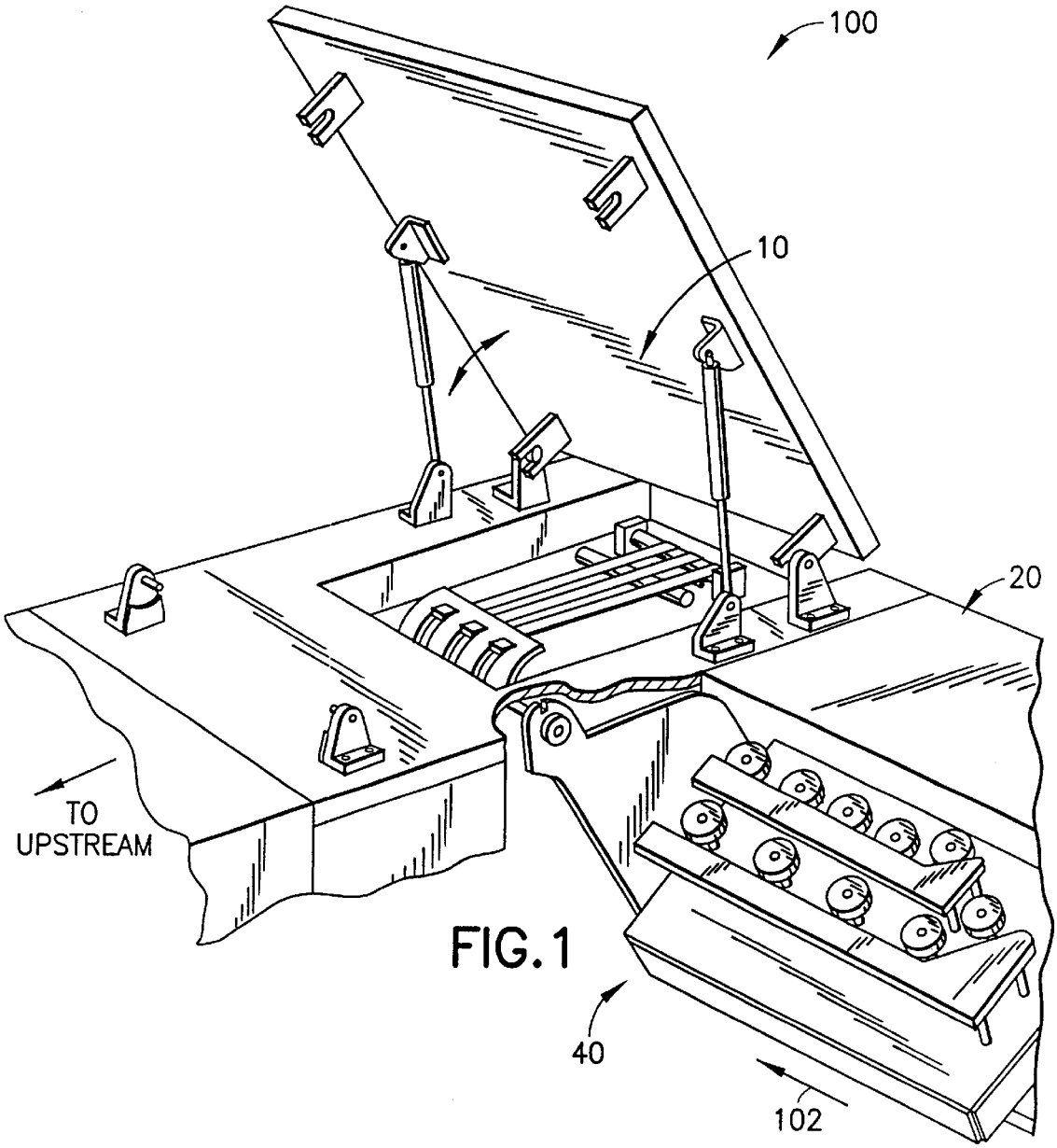
FIG. 1 is a perspective view of an envelope insertion device showing an envelope feeder and an envelope staging area.

FIG. 1 is a perspective view of a section of an envelope insertion machine 100, showing an envelope staging area 10 where enclosure material (not shown) gathered at the upstream end of the envelope insertion machine 10 is inserted into an envelope (not shown). Also shown in FIG. 1 is a section of an envelope feeder 20 and the dual bin envelope supply device 40 of the present invention. When in use, the dual bin envelope supply device 40 must be pushed along a direction 102 to be placed directly under the envelope staging area 10 so that envelopes entering the dual bin supply device 40 are sequentially moved to the envelope staging area 10 for enclosure material insertion.

Figure 2:
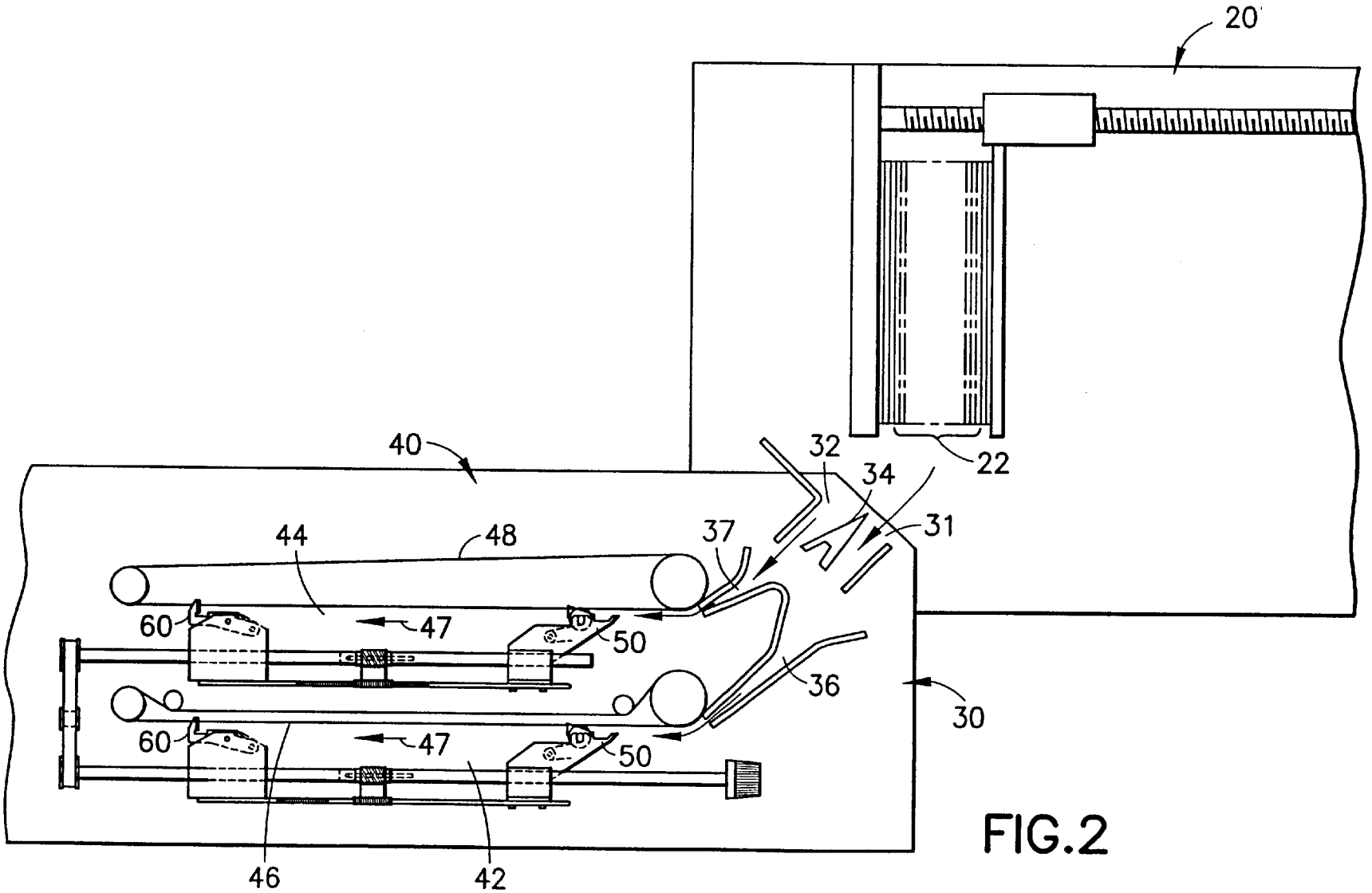
FIG. 2 is a schematic representation of an envelope insertion device showing the relationship between the envelope feeder and the dual bin envelope supply device of the present invention.

FIG. 2 illustrates the relationship between the envelope feeder 20 and the dual bin envelope supply device 40. As shown, the dual bin envelope supply device 40 has a first envelope bin 42 and a second envelope bin 44 to receive envelopes 22 fed by the envelope feeder 20 through dual envelope supply paths 30. The dual envelope supply paths 30 include a first entrance 31 and a second entrance 32. A flipper gate 34 is used to alternately open and close the entrances 31 and 32 so that the envelopes 22 are fed by the envelope feeder 20 in an alternate fashion into the first entrance 31 and the second entrance 32. The envelopes 22 entering through the first entrance 31 and second entrance 32 are transported through a first exit 36 and a second exit 37, respectively, into the envelope bins 42, 44 with the aid of transport belts 46 and 48 along a direction 47. As shown, each envelope bin 42, 44 has a catch mechanism 50 at one end to admit an envelope 22 into the envelope bin and a stop mechanism 60 at the other end to retain an entered envelope (not shown) within the envelope bin 42, 44.

Figure 3:
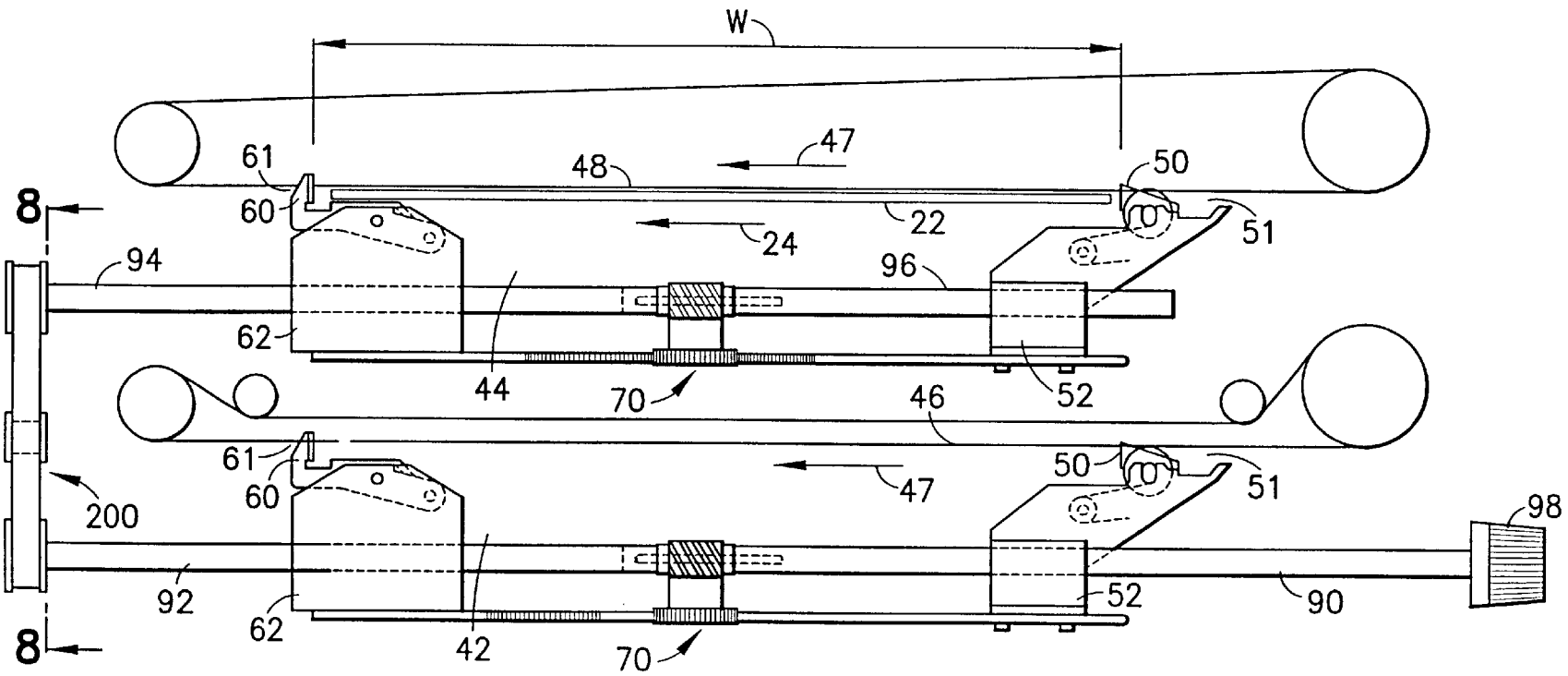
FIG. 3 is a schematic representation of the dual envelope bins showing the catch mechanism and the stop mechanism for each envelope bin.

As shown in FIG. 3, each of the envelope bins 42, 44 has a width W. Preferably, both envelope bins 42, 44 have the same bin width W. The bin width W of the envelope bin 42, 44 is defined by the catch mechanism 50 at the bin entrance 51 and the stop mechanism 60 at an opposite end 61. The catch mechanism 50 is mounted on a front end housing 52 while the stop mechanism 60 is mounted on a rear end housing 62. An adjustment mechanism 70, which is mechanically connected to the front end housing 52 and the rear end housing 62, is used to adjust the separation between the catch mechanism 50 and the stop mechanism 60, and therefore the width W of the envelope bins 42, 44, in accordance with the width of the envelope 22. As shown, the envelope 22 enters the envelope bin 44 along an entering direction 24 through the bin entrance 51. The catch mechanism 51, which is a one-way device, is used to prevent an envelope 22 which has entered the bin 42, 44 from moving out of the bin 42, 44 through the entrance 51 along a direction opposite the direction 24. The stop mechanism 60 is used to keep the entered envelope 22 from moving out of the bin 42, 44 through the opposite end 61 along the entering direction 24. Also shown in FIG. 3 are a first adjustment shaft 90, and a first extension shaft 92 which are engaged with the adjustment mechanism 70 of the first envelope bin 42. An adjustment knob 98 is used to turn the first adjustment shaft 92 in order to adjust the width W of the first envelope bin 42 via the adjustment mechanism 70. Furthermore, a second adjustment shaft 94 and a second extension shaft 96 are engaged with the adjustment mechanism 70 of the second envelope bin 44 for adjusting the width W of the second envelope bin 44. A coupling device 200 is used to provide a mechanical coupling between the first extension shaft 92 and the second adjustment shaft 94 so that the width W of both the first envelope bin 42 and the width W of the second envelope bin 44 can be simultaneously adjusted.

Figure 4A:
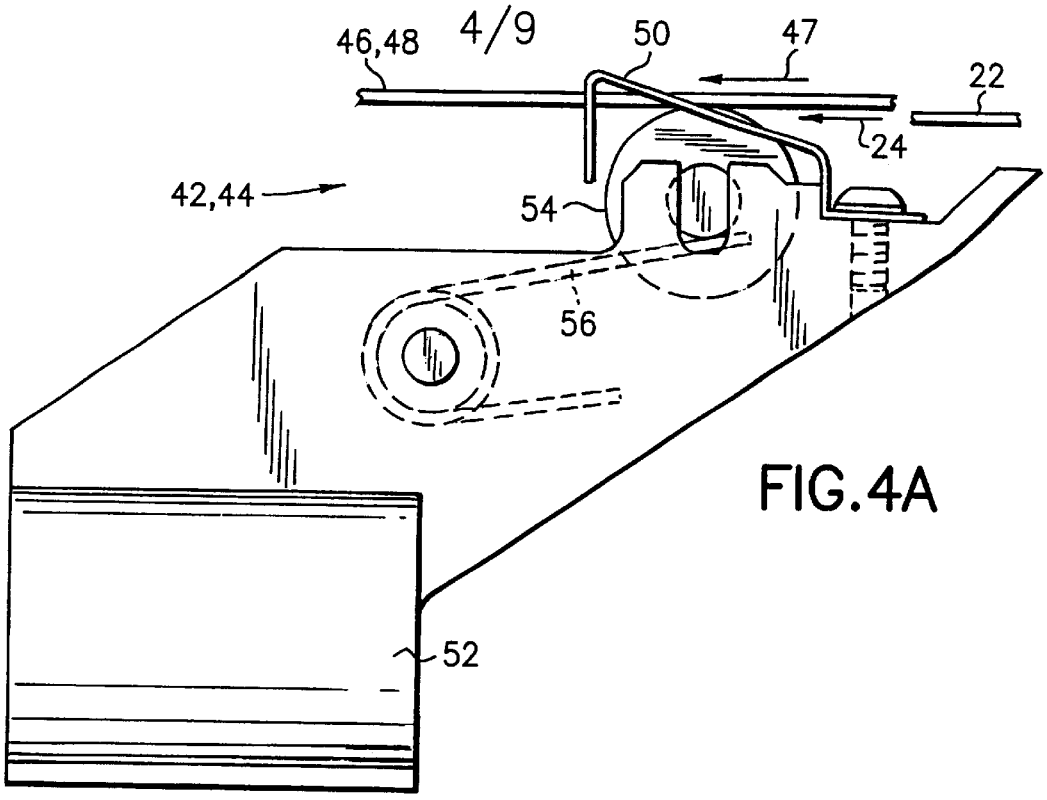
FIGS. 4A and 4B are isometric views of the catch mechanism showing the detailed structure thereof.
Figure 4B:
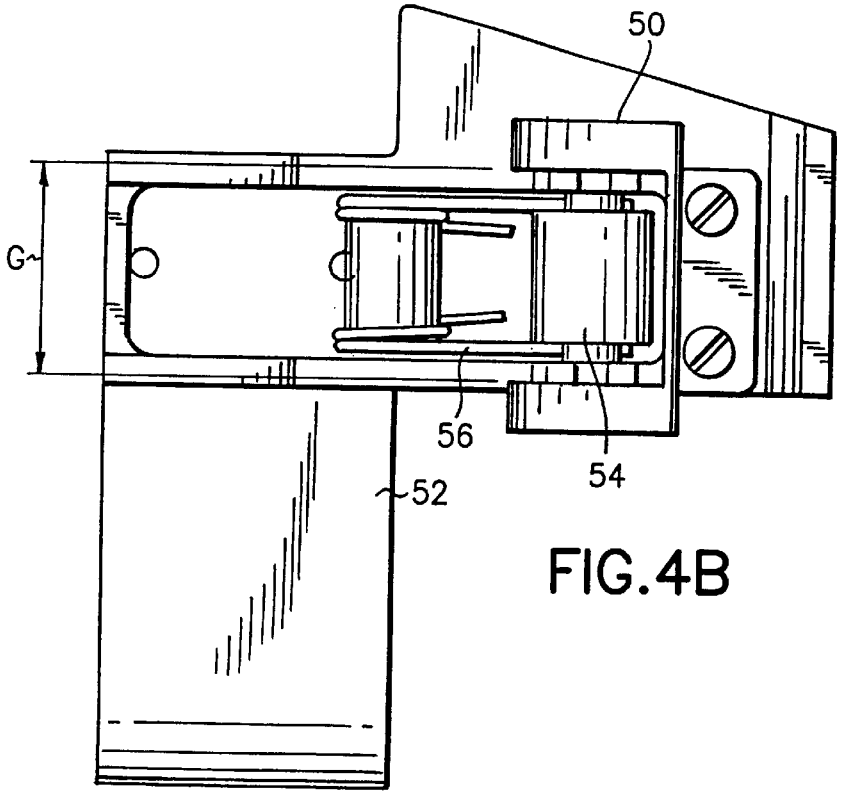

FIGS. 4A and 4B are isometric views of the catch mechanism. As shown in FIG. 4A, the front end housing 52 includes a roller 54 and a spring 56 positioned at the bin entrance 51 to push an incoming envelope 22 against the transport belt 46, 48 in order to move the envelope 22 into the envelope bin 42, 44. The catch mechanism 50, which has a gap G (FIG. 4B) wider than the width (not shown) of the transport belt 46, 48, is placed into the moving path of the envelope 22. As the envelope 22 is moved into the envelope bin 42, 44 along the entering direction 24, it depresses the stop mechanism 51 away from the transport belt 42, 44. After the envelope 22 has entered into the envelope bin 42, 44, the catch mechanism 51 returns to its original position thereby preventing an entered envelope from moving out of the envelope bin 42, 44 through the front entrance 51.

Figure 5A:
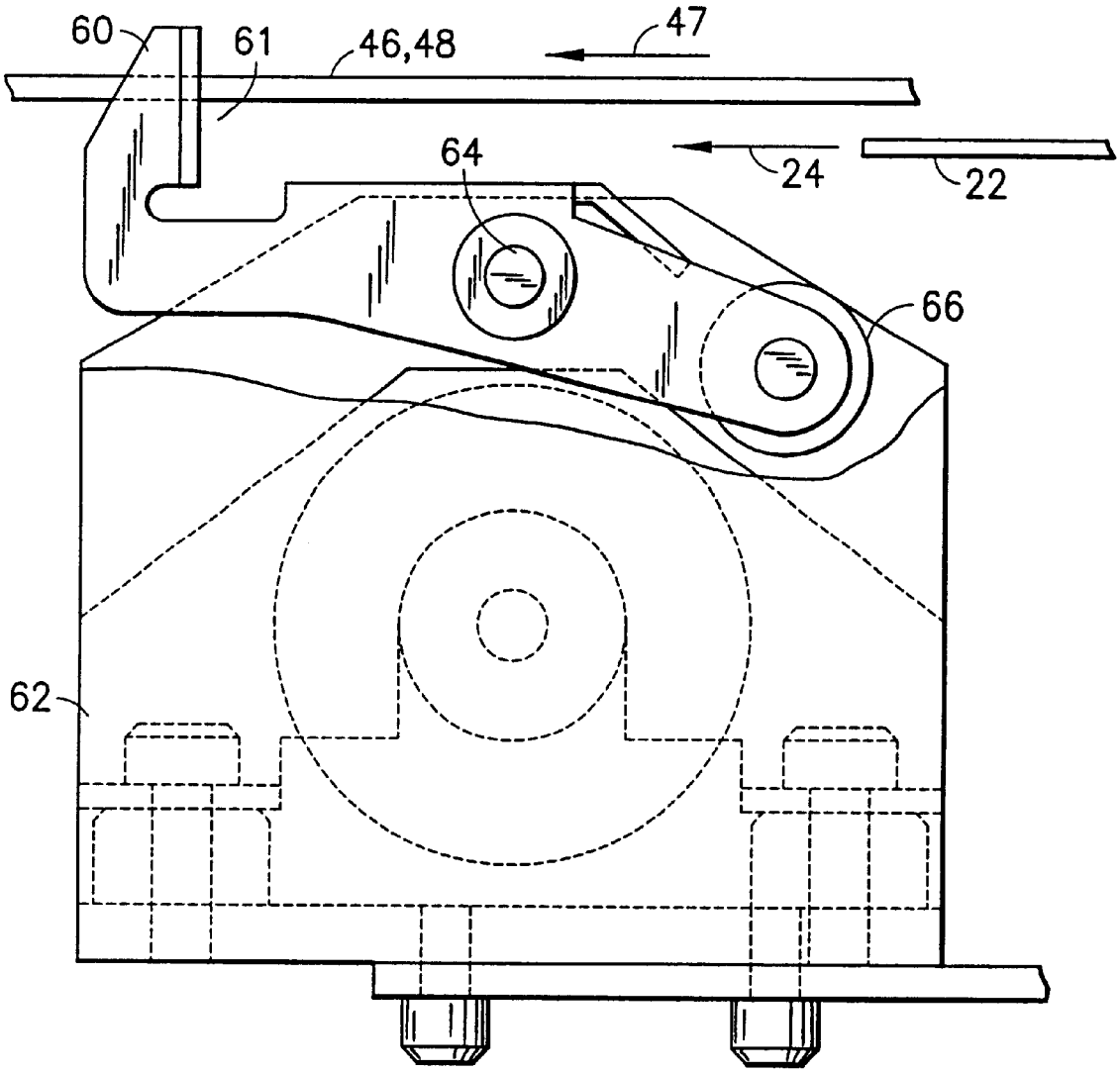
FIGS. 5A and 5B are isometric views of the stop mechanism showing the two operable positions of the stop mechanism.
Figure 5B:
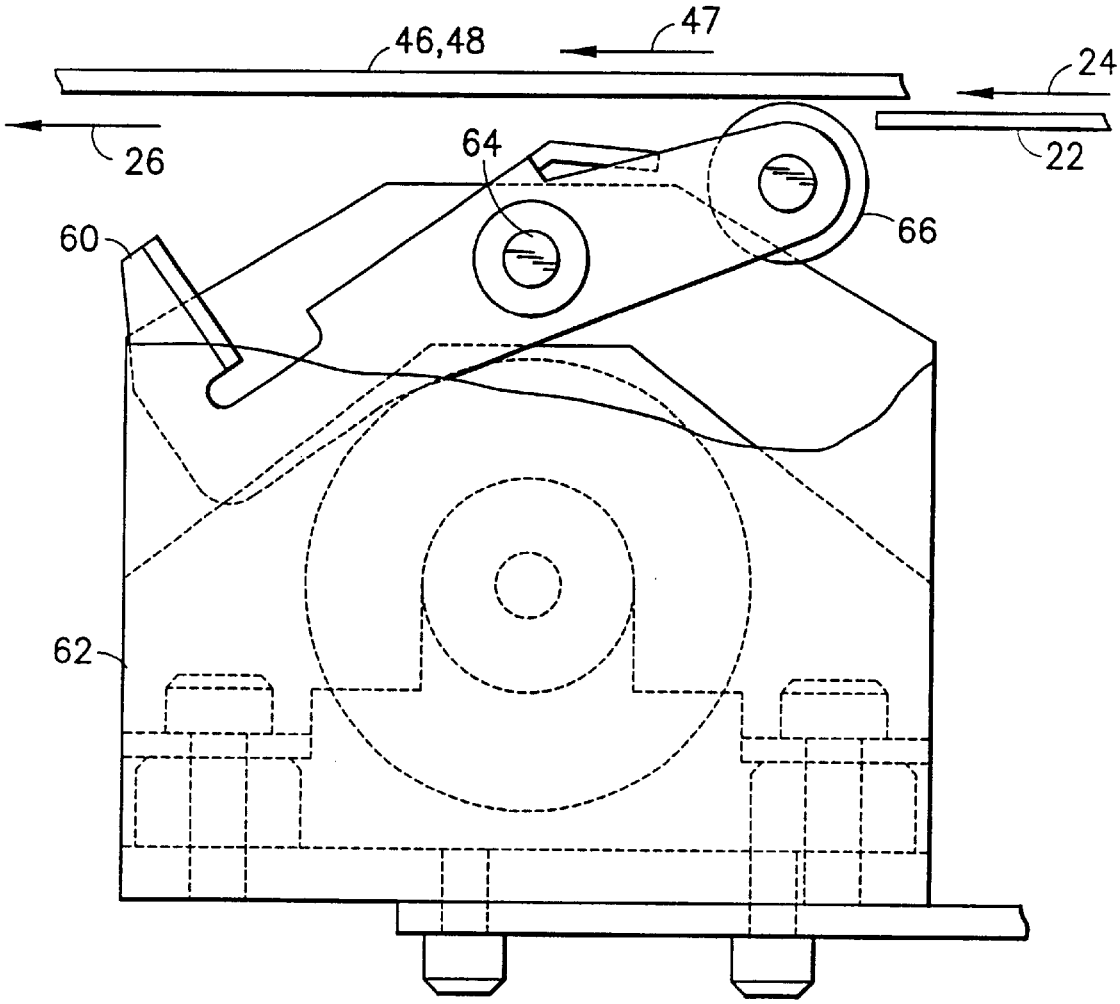

As shown in FIGS. 5A and 5B, the stop mechanism 60 is pivotably mounted on the rear end housing 62 at pivot 64 so that the stop mechanism 60 can be operated in a first position and a second position. In normal operation, as shown in FIG. 5A, the stop mechanism is operated at the first position. As shown in FIG. 5A, the stop mechanism 60 is placed into the moving path of an envelope 22 which enters the envelope bin 42, 44 along the direction 24. When operated in the first position, the stop mechanism 60 keeps the entered envelope 22 from exiting the envelope bin 42, 44 through the rear end 61 along a direction 26. Accordingly, the entered envelope 22 is temporarily stored in the bin 42, 44 until it is moved out of the bin 42, 44 in a direction perpendicular to the direction 24.

In practice, when an envelope 22 enters an envelope bin 42, 44, the flap (not shown) of the envelope 22 is opened slightly by an opening device (not shown). After the envelope 22 is moved out of the bin 42, 44 to the envelope staging area 10, the flap is fully flipped out to allow enclosure material to be inserted into the envelope 22. Thus, if the flap of the entered envelope 22 is not opened slightly by the opening device after the envelope 22 has entered the envelope bin 42, 44, the flap will not be fully flipped out in the envelope staging area 10. Therefore, that envelope must be ejected from the envelope bin 42, 44 through the opposite end 61. In that situation, the stop mechanism 60 is operated at the second position as shown in FIG. 5B.

As shown in FIG. 5B, the stop mechanism 60 is moved away from the transport belt 46, 48. At the same time, a roller 66 pushes an entered envelope (not shown) against the transport belt 46, 48 causing the entered envelope to be moved out of the envelope bin 42, 44 through the opposite end 61 along a direction 26.

Figure 6A:
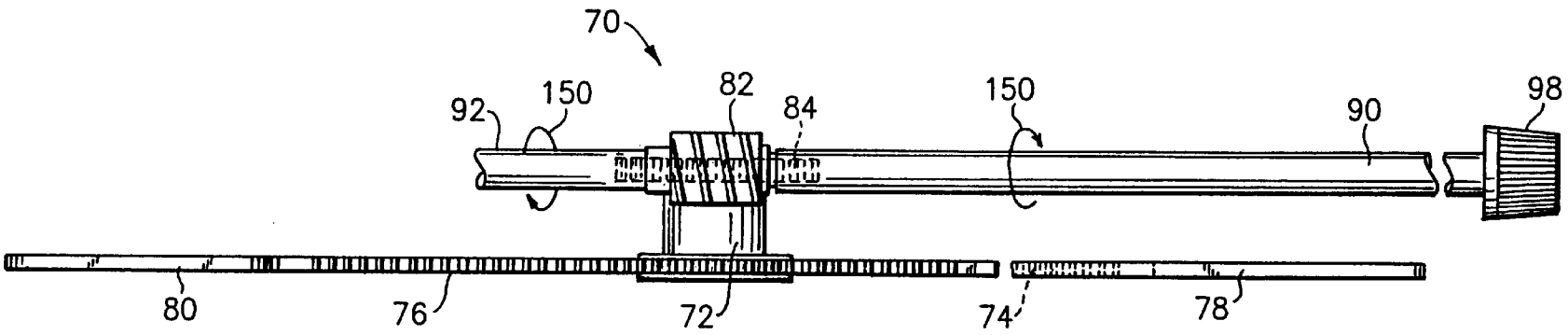
FIGS. 6A and 6B are isometric views of the adjustment mechanism for adjusting the separation between the stop mechanism and the catch mechanism for each envelope bin.
Figure 6B:
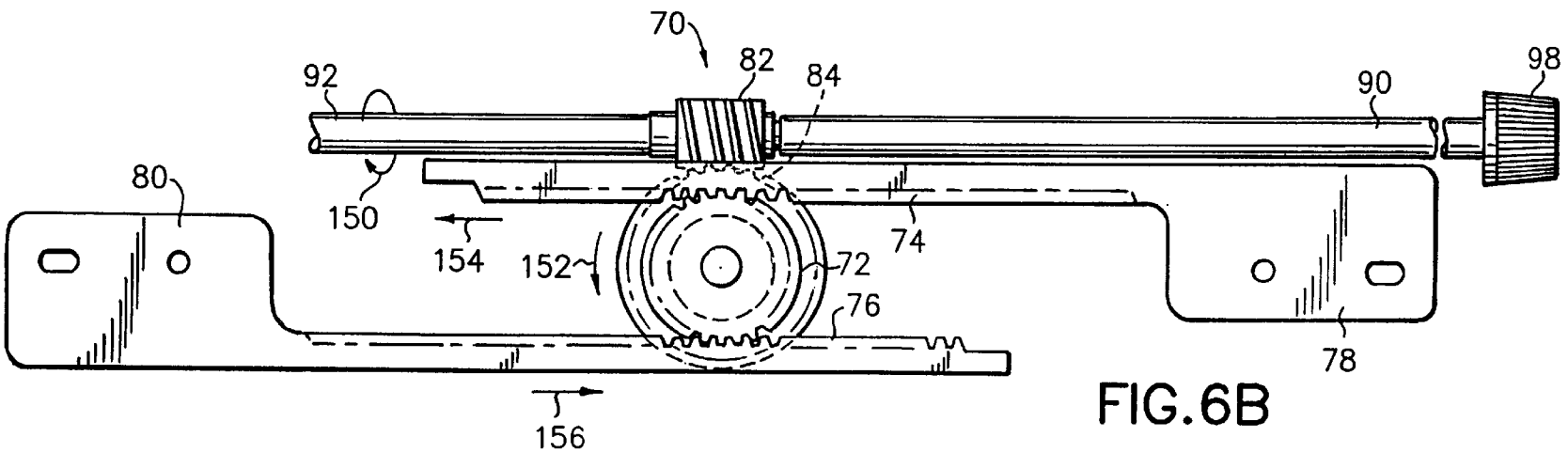

FIG. 6A and FIG. 6B are isometric views of the adjustment mechanism 70 for adjusting the bin width W of the first envelope bin 42. As shown, the adjustment 70 includes a pinion 72 engaged with a first rack 74 and a second rack 76 for movement. The first rack 74 is fixedly mounted on a first mounting bracket 78 and the second rack 76 is fixedly mounted on a second mounting bracket 80. When the pinion 72 turns in a counter-clockwise direction 152, the first mounting bracket 78 is caused to move along a direction 154 while the second mounting bracket 80 is caused to move along an opposition direction 156. The first mounting bracket 78 is used to mount the front end housing 52 (FIG. 3), and the second mounting bracket 80 is used to mount the rear end housing 62 (FIG. 3). Thus, when the pinion 72 turns in the counter-clockwise direction 152, the front end housing 52 and the rear end housing 62 are caused to move in opposite directions away from each other, thereby increasing the width W of the first envelope bin 42. Similarly, when the pinion 72 turns in a clockwise direction, the front end housing 52 and the rear end housing 62 are caused to move in opposite directions towards each other, thereby reducing the width W of the first envelope bin 42.

Figure 7:
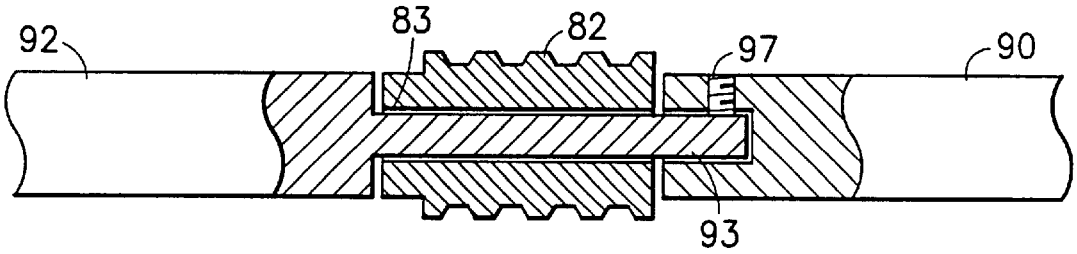
FIG. 7 is a cross-sectional view of part of the adjustment mechanism showing the mechanical linkage between an adjustment shaft and an extension shaft.

The pinion 72 is fixedly mounted to a worm wheel 84, which is in direct contact with a worm gear 82 for motion. The worm gear 82 is coupled to the first adjustment shaft 90 which is fixedly connected to the adjustment knob 98. When the adjustment knob 98 is turned in a clockwise direction 150, the worm gear 82 is caused to turn the worm wheel 84 and the pinion 72 in the counter-clockwise direction 152. Similarly, when the adjustment knob is turned in a counter-clockwise direction (not shown), the pinion 72 is caused to turn in a clockwise direction. As shown in FIGS. 6A and 6B, the extension shaft 92 is coupled to the first adjustment shaft 90 through the worm gear 82 so that the first extension shaft 92 is caused to turn in synchronism with the first adjustment shaft 90. The detail of the coupling between the first adjustment shaft 90 and the first extension shaft 92 is shown in FIG. 7. Preferably, the coupling between the second adjustment shaft 94 and the second extension shaft 96 is similar.

As shown in FIG. 7, the worm gear 82 has an aperture 83 along a rotation axis 135 to allow the first extension shaft 92 to be coupled to the first adjustment shaft 90. In particular, the aperture 83 is a through hole having a D-shaped cross section (not shown), and the extension shaft 92 has an end tip 93 having a D-shaped cross section to fit the aperture 83. The end tip 93 of the extension shaft 92 is secured to the first adjustment shaft 90 by one or more set screws 97. Due to the fitting of the D-shape end tip 93 to the D-shaped aperture 83, the worm gear 82 is caused to turn in synchronism with the first extension shaft 92, which is turned along with the first adjustment shaft 90.

Figure 8:
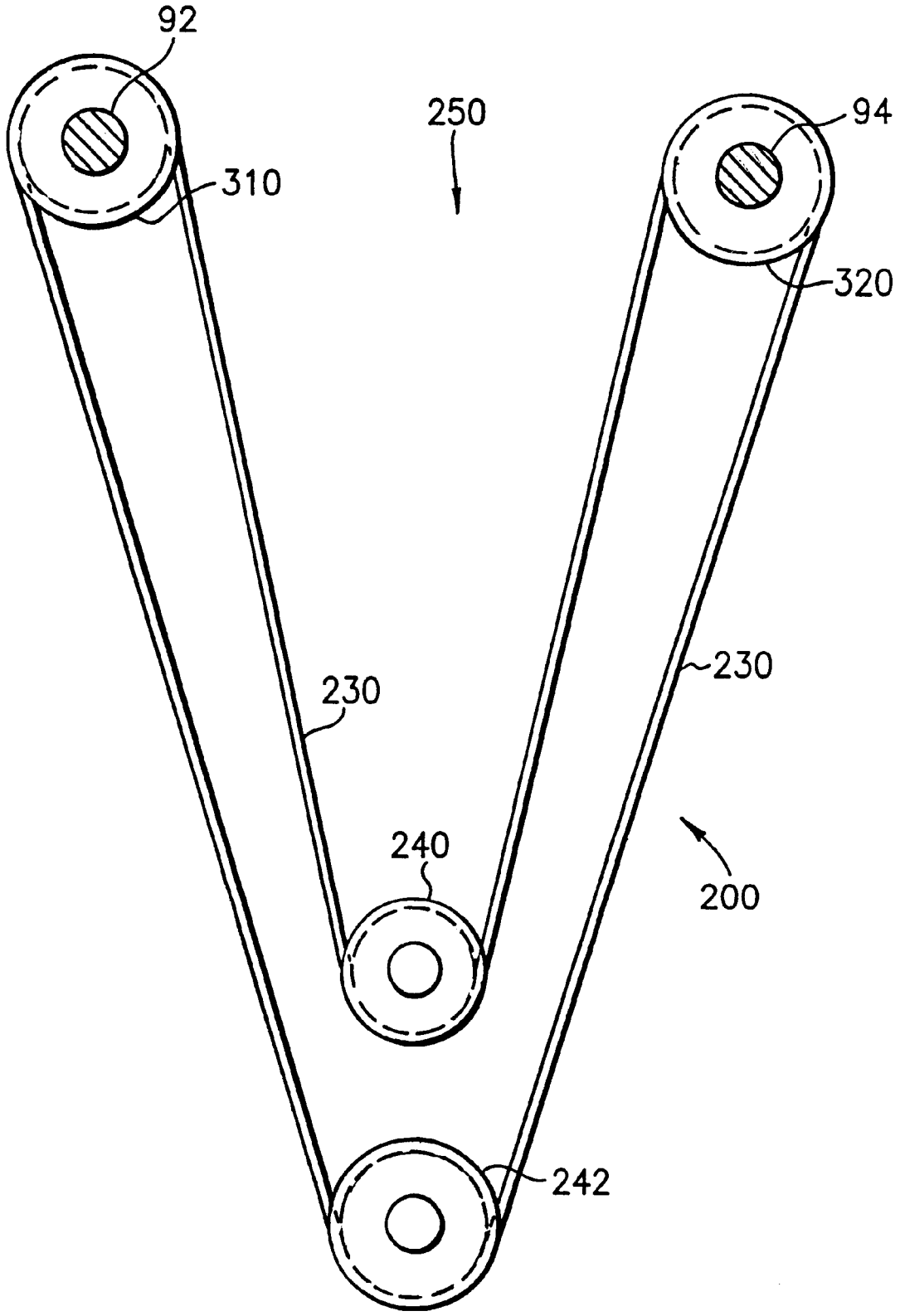
FIG. 8 is a side view of a coupling device showing the mechanical linkage between the two envelope bins for simultaneously adjusting the width of the envelope bins.

FIG. 8 illustrates the coupling device 200 which provides a mechanical coupling between the first extension shaft 92 of the first envelope bin 42 and the second adjustment shaft 94 of the second envelope bin 44. As shown, a first pulley 210 is fixedly mounted to the extension shaft 92 for rotation, and a second pulley 220 is fixedly mounted to the second shaft 94. A belt 230, preferably a timing belt, is used to provide linkage between the first pulley 210 and the second pulley 220 so that the second pulley 220 is caused to rotate in synchronism with the first pulley 210. Furthermore, two idler pulleys 240 and 242 are used to push the belt 230 away from the pulleys 92 and 94 to make a passage way 250 so as to allow an envelope ejected out of the envelope bins 42 and 44 along the direction 26 (FIG. 5B) to move out of the dual bin envelope supply device 40.

Thus, what has been described is a system for transporting envelopes from an envelope feeder to an envelope staging area. The system includes two envelope bins to receive envelopes fed by the envelope feeder from two envelope supply paths, wherein the supply paths are alternately opened and closed by a flipper gate. In effect, the envelope transport system of the present invention provides a parallel process to increase the throughput of the envelope insertion machine. It should be noted that parallel processing of envelopes can also be carried out in an envelope supply device having three or more envelope bins and supply paths. Furthermore, the above-described method for the adjustment of the bin width involves rack-and-pinion systems. However, it is also possible to use spur gears or other mechanical means to adjust the separation between the front housing and the rear housing.

Therefore, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A system for transporting envelopes in an envelope insertion device having an envelope feeder to release envelopes, at least one enclosure feeder to release enclosure documents, and an envelope staging area where released enclosure documents are inserted into the released envelopes, said system comprising a first envelope bin and a second envelope bin for alternately receiving one envelope at a time from the envelope feeder, wherein the envelope received into one of the envelope bins is temporarily stored while waiting for a preceding envelope received into the other envelope bin to be transported to the envelope staging area;

wherein each envelope bin has an entrance end to receive an envelope along an entering direction and an opposing end, and each envelope bin further includes a catch mechanism located at the entrance end to prevent an envelope which has entered the envelope bin from moving out of the entrance end in a direction opposite the entering direction; and a stop mechanism located at the opposing end to prevent an entered envelope from exiting the envelope bin through the opposing end further along the entering direction, wherein the catch mechanism and the stop mechanism are separated by a distance;

wherein the envelopes have a width and the envelope bin has a width defined by the separation distance between the catch mechanism and the stop mechanism, said system further including an adjustment device to adjust the separation distance between the stop mechanism and the catch mechanism according to the width of the envelopes;

wherein the adjustment device comprises:

a first adjustment shaft;

a first pinion engaged with the first adjustment shaft for rotation;

a first rack for mounting the catch mechanism of the first envelope bin, wherein the first rack is engaged with the first pinion for movement in a first direction responsive to the rotation of the first pinion; and a second rack for mounting the stop mechanism of the first envelope bin, wherein the second rack is engaged with the first pinion for movement in a second direction responsive to the rotation of the first pinion, wherein the second direction is opposite to the first direction, whereby the catch mechanism and the stop mechanism of the first bin are caused to move in opposite directions relative to the first pinion when the first adjustment shaft is turned;

wherein the adjustment device further comprises:

a second adjustment shaft;

a second pinion engaged with the second adjustment shaft for rotation;

a third rack for mounting the catch mechanism of the second envelope bin, wherein the third rack is engaged with the second pinion for movement in a third direction responsive to the rotation of the second pinion; and a fourth rack for mounting the stop mechanism of the second envelope bin, wherein the fourth rack is engaged with the second pinion for movement in a fourth direction responsive to the rotation of the second pinion, wherein the fourth direction is opposite to the third direction, whereby the catch mechanism and the stop mechanism of the second bin are caused to move in opposite directions relative to the second pinion when the second adjustment shaft is turned; and wherein the first envelope bin is substantially parallel to the second envelope bin and wherein the first adjustment shaft is coupled to the second adjustment shaft so as to cause the second adjustment shaft to turn responsive to the turning of the first shaft such that the third direction is substantially the same as the first direction.

2. A system for transporting envelopes in an envelope insertion device having an envelope feeder to release envelopes, at least one enclosure feeder to release enclosure documents, and an envelope staging area where released enclosure documents are inserted into the released envelopes, said system comprising a first envelope bin and a second envelope bin for alternately receiving one envelope at a time from the envelope feeder, wherein the envelope received into one of the envelope bins is temporarily stored while waiting for a preceding envelope received into the other envelope bin to be transported to the envelope staging area;

wherein each envelope bin has an entrance end to receive an envelope along an entering direction and an opposing end, and each envelope bin further includes a catch mechanism located at the entrance end to prevent an envelope which has entered the envelope bin from moving out of the entrance end in a direction opposite the entering direction; and a stop mechanism located at the opposing end to prevent an entered envelope from exiting the envelope bin through the opposing end further along the entering direction, wherein the catch mechanism and the stop mechanism are separated by a distance;

wherein the envelopes have a width and the envelope bin has a width defined by the separation distance between the catch mechanism and the stop mechanism, said system further including an adjustment device to adjust the separation distance between the stop mechanism and the catch mechanism according to the width of the envelopes;

wherein the adjustment device comprises:

a first adjustment shaft;

a first pinion engaged with the first adjustment shaft for rotation;

a first rack for mounting the catch mechanism of the first envelope bin, wherein the first rack is engaged with the first pinion for movement in a first direction responsive to the rotation of the first pinion; and a second rack for mounting the stop mechanism of the first envelope bin, wherein the second rack is engaged with the first pinion for movement in a second direction responsive to the rotation of the first pinion, wherein the second direction is opposite to the first direction, whereby the catch mechanism and the stop mechanism of the first bin are caused to move in opposite directions relative to the first pinion when the first adjustment shaft is turned;

wherein the adjustment device further comprises:

a second adjustment shaft;

a second pinion engaged with the second adjustment shaft for rotation;

a third rack for mounting the catch mechanism of the second envelope bin, wherein the third rack is engaged with the second pinion for movement in a third direction responsive to the rotation of the second pinion; and a fourth rack for mounting the stop mechanism of the second envelope bin, wherein the fourth rack is engaged with the second pinion for movement in a fourth direction responsive to the rotation of the second pinion, wherein the fourth direction is opposite to the third direction, whereby the catch mechanism and the stop mechanism of the second bin are caused to move in opposite directions relative to the second pinion when the second adjustment shaft is turned; and wherein the first adjustment shaft is further coupled to an extension shaft to cause the extension shaft to turn in synchronism with the first adjustment shaft, said system further comprising a coupling device for coupling the extension shaft to the second adjustment shaft so as to mechanically connect the first adjustment shaft and the second adjustment shaft in order to cause the second adjustment shaft to turn in synchronism with the first adjustment shaft.

3. The system of claim 2, wherein the first pinion is engaged to the first adjustment shaft with a worm gear and a worm wheel, wherein the worm gear is mechanically coupled to the first adjustment shaft for rotation and the worm wheel is fixedly mounted on the first pinion, and wherein the worm gear is in direct contact with the worm wheel for causing the worm wheel to turn when the worm gear is turned.

4. The system of claim 3, wherein the worm gear has a rotation axis and an aperture made through the worm gear along the rotation axis to allow the extension shaft to be fixedly coupled to the first extension shaft through the aperture.

5. The system of claim 2, wherein the coupling device comprises:

a first pulley fixedly mounted on the extension shaft;

a second pulley fixedly mounted on the second adjustment shaft; and a belt engaging the first and second pulley so as to cause the second pulley to turn in synchronism with the first pulley.

6. The system of claim 2, wherein the stop mechanism is operable at a first position to prevent an entered envelope from exiting the envelope bin along the entering direction; and a second position to allow the entered envelope to be removed from the envelope bin further along the entering direction, if so desired.

7. The system of claim 5, wherein the stop mechanism is operable at a first position to prevent an entered envelope from exiting the envelope bin along the entering direction; and a second position to allow the entered envelope to exit the envelope bin in an exiting path further along the entering direction, said coupling device further including a pair of third pulleys to keep the belt away from the exiting path so as to allow an envelope exited from the envelope bin to move out of the system.

8. The system of claim 2, wherein the first adjustment shaft has a turn knob fixedly mounted thereon, said turn knob being used to turn the first shaft in order to adjust the distance between the stop mechanism and the catch mechanism.

9. A method of simultaneously adjusting dual envelope supply paths in an envelope insertion device having an envelope feeder to release envelopes having a width, at least one enclosure feeder to release enclosure documents, and an envelope staging area where the released documents are inserted into the released envelopes, wherein the dual envelope supply paths are located between the envelope feeder and the envelope staging area, wherein one of the envelope supply paths includes a first envelope bin having a width and the other envelope supply path includes a second envelope bin having a width;

wherein envelopes are received into the first and second envelope bins in an alternate fashion through the envelope supply paths so as to allow an envelope received into one envelope bin to slow down in order to wait for the envelope received into the other envelope bin to be transported to the envelope staging area; and wherein each envelope bin has an entrance end to receive an envelope and an opposing end, and each envelope bin further includes a catch mechanism located at the entrance end to prevent an envelope which has entered the bin from moving out of the envelope bin through the entrance end, and a stop mechanism located at the opposing end to prevent the entered envelope from exiting the opposing end, wherein the stop mechanism and the catch mechanism are separated by a distance defining the width of the envelope bin; said method comprising the steps of:

a) engaging the stop mechanism and the catch mechanism of the first envelope bin with a first adjustment device so as to change the distance between the stop mechanism and the catch mechanism of the first envelope bin according to the width of the envelopes;

b) engaging the stop mechanism and the catch mechanism of the second bin with a second adjustment device so as to change the distance between the stop mechanism and the catch mechanism of the second envelope bin according to the width of the envelopes; and c) coupling the first adjustment device to the second adjustment device so as to cause the distance between the stop mechanism and the stop mechanism in both envelope bins to change simultaneously.

10. The method of claim 9, wherein the first adjustment device comprises:

a first adjustment shaft;

a first pinion engaged with the first adjustment shaft for rotation;

a first rack for mounting the catch mechanism of the first bin, wherein the first rack is engaged with the first pinion for movement in a first direction responsive to the rotation of the first pinion;

a second rack for mounting the stop mechanism of the second bin, wherein the second rack is engaged with the first pinion for movement in a second direction response to the rotation of the first pinion such that the second direction is opposite the first direction relative to the first pinion, whereby the catch mechanism and the stop mechanism of the first bin are caused to move in opposite directions relative to the first pinion when the first adjustment shaft is turned.

11. The method of claim 10, wherein the second adjustment device comprises:

a second adjustment shaft;

a second pinion engaged with the second adjustment shaft for rotation;

a third rack for mounting the catch mechanism of the second bin, wherein the third rack is engaged with the second pinion for movement in a third direction responsive to the rotation of the second pinion;

a fourth rack for mounting the stop mechanism of the second bin, wherein the fourth rack is engaged with the second pinion for movement in a fourth direction responsive to the rotation of the second pinion such that the fourth direction is opposite to the third direction relative to the second pinion, whereby the catch mechanism and the stop mechanism of the second bin are caused to move in opposite directions relative to the second pinion when the second adjustment shaft is turned.

12. The method of claim 11, wherein the first adjustment shaft is engaged to a first pulley for rotation and the second adjustment shaft is engaged to a second pulley for rotation, and wherein the first pulley is coupled to the second pulley with a belt so as to cause the second pulley to rotate in synchronism with the first pulley.

* * * * *